US011903460B2

(12) United States Patent
Chang et al.

(10) Patent No.: US 11,903,460 B2
(45) Date of Patent: Feb. 20, 2024

(54) WEARABLE DEVICE

(71) Applicant: HTC Corporation, Taoyuan (TW)

(72) Inventors: Li-Hsun Chang, Taoyuan (TW); Yu-Hsun Chung, Taoyuan (TW); Chen-Fu Chang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 6 days.

(21) Appl. No.: 17/858,087

(22) Filed: Jul. 6, 2022

(65) Prior Publication Data

US 2024/0008601 A1 Jan. 11, 2024

(51) Int. Cl.

| | |
|---|---|
| ***A44C 5/14*** | (2006.01) |
| ***A44C 5/16*** | (2006.01) |
| ***A44C 5/20*** | (2006.01) |

(52) U.S. Cl.

CPC ..... *A44C 5/145* (2013.01); *A44C 5/16* (2013.01); *A44C 5/2042* (2013.01); *Y10T 24/4782* (2015.01)

(58) Field of Classification Search

CPC ..... A44C 5/145; A44C 5/2071; A44C 5/20; A44C 5/16; A44C 5/14; A44C 5/2042; A44D 2205/00; Y10T 24/4755; Y10T 24/4782

See application file for complete search history.

(56) References Cited

U.S. PATENT DOCUMENTS

| | | | | |
|---|---|---|---|---|
| 2016/0037841 | A1* | 2/2016 | Dey | A44C 27/001 2/170 |
| 2019/0029373 | A1* | 1/2019 | Shaffer | A44C 5/2071 |
| 2020/0029661 | A1* | 1/2020 | Tobiassen | A44C 5/22 |
| 2021/0298395 | A1* | 9/2021 | Halpern | A41D 20/00 |
| 2021/0308954 | A1 | 10/2021 | Sano et al. | |

FOREIGN PATENT DOCUMENTS

| | | |
|---|---|---|
| CN | 215775998 | 2/2022 |
| TW | 201729712 | 9/2017 |
| TW | M583277 | 9/2019 |

* cited by examiner

*Primary Examiner* — Robert Sandy
*Assistant Examiner* — Michael S Lee
(74) *Attorney, Agent, or Firm* — JCIPRNET

(57) ABSTRACT

A wearable device includes a main body and a band body. The opposite sides of the main body are provided with a tail portion and a hook portion, respectively. An open groove is provided between the hook portion and other parts of the main body. One end of the band body is connected to the tail portion. The band body enters the open groove from an open side of the open groove and is folded back around the hook portion. The other end of the band body is fixed to a part of the band body, so that the band body is coupled to the hook portion, and the band body is adapted to fix the main body to a subject.

5 Claims, 6 Drawing Sheets

WEARABLE DEVICE

BACKGROUND

Technical Field

The disclosure relates to a wearable device, and in particular, to a wearable device that is easily fixed to a subject.

Description of Related Art

When a user fixes a current common wearable device to the body, it is often necessary to use both hands to perform the operation, or the wearable device needs to be leaned on a desktop or other objects to easily complete the wearing action. For example, when the user wears a watch on the wrist, it is necessary to lean the wrist on which the watch is worn against an object, and wear the watch with the other hand. However, for a user who is unfamiliar with one-handed operation, it takes a lot of time to put on or take off the wearable device, causing inconvenience to the user. Moreover, if the user is a little careless, the wearable device is easy to fall on the ground and be damaged.

SUMMARY

The disclosure provides a wearable device, which may improve the convenience of a user when putting on or taking off the wearable device.

The wearable device of the disclosure includes a main body and a band body. The opposite sides of the main body are provided with a tail portion and a hook portion, respectively. An open groove is provided between the hook portion and other parts of the main body. One end of the band body is connected to the tail portion. The band body enters the open groove from an open side of the open groove and is folded back around the hook portion. The other end of the band body is fixed to a part of the band body, so that the band body is coupled to the hook portion, and the band body is adapted to fix the main body to a subject.

Based on the above, in the wearable device of the disclosure, the user only needs to pass the band body around the hook portion and fix the band body after confirming that the length is appropriate, and the wearable device may be worn. Moreover, the wearable device may be taken off by reverse operation. The method of operating the wearable device is simple, and the time required for putting on and taking off the wearable device is reduced.

DESCRIPTION OF THE EMBODIMENTS

Figure 1:
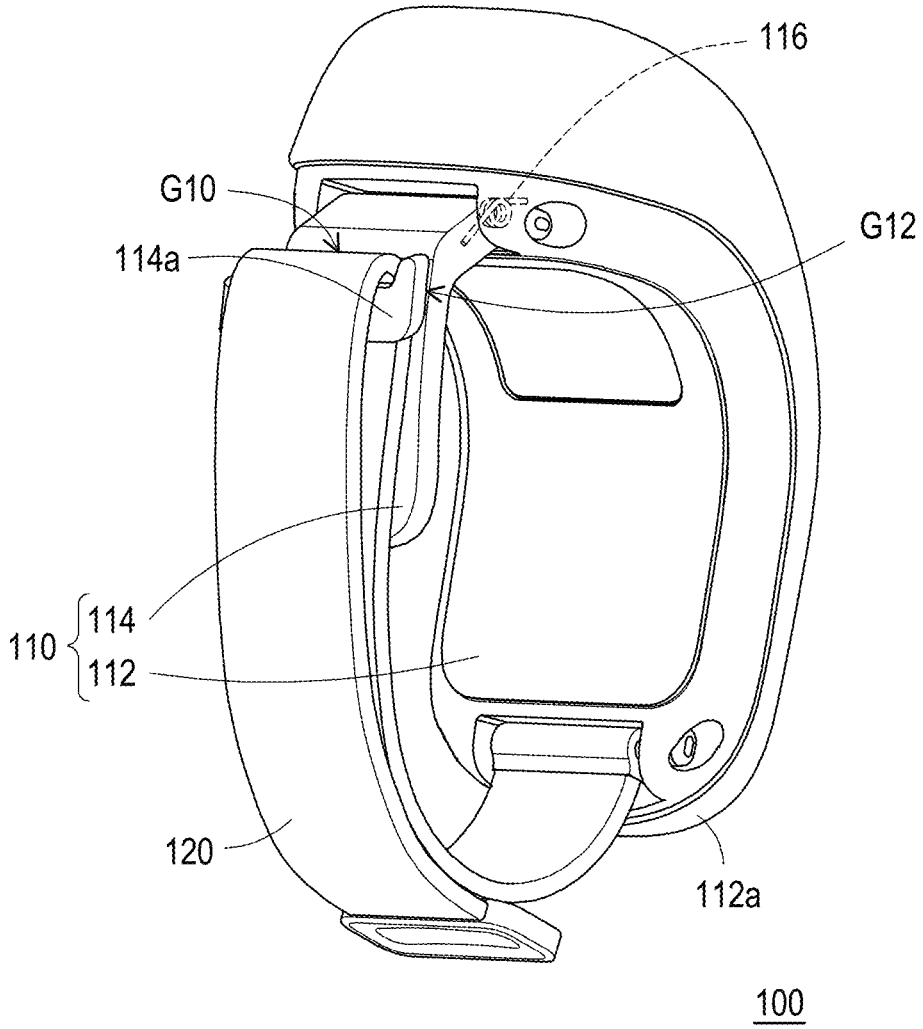
FIG. 1 is a schematic diagram of a wearable device according to an embodiment of the invention.
Figure 2:
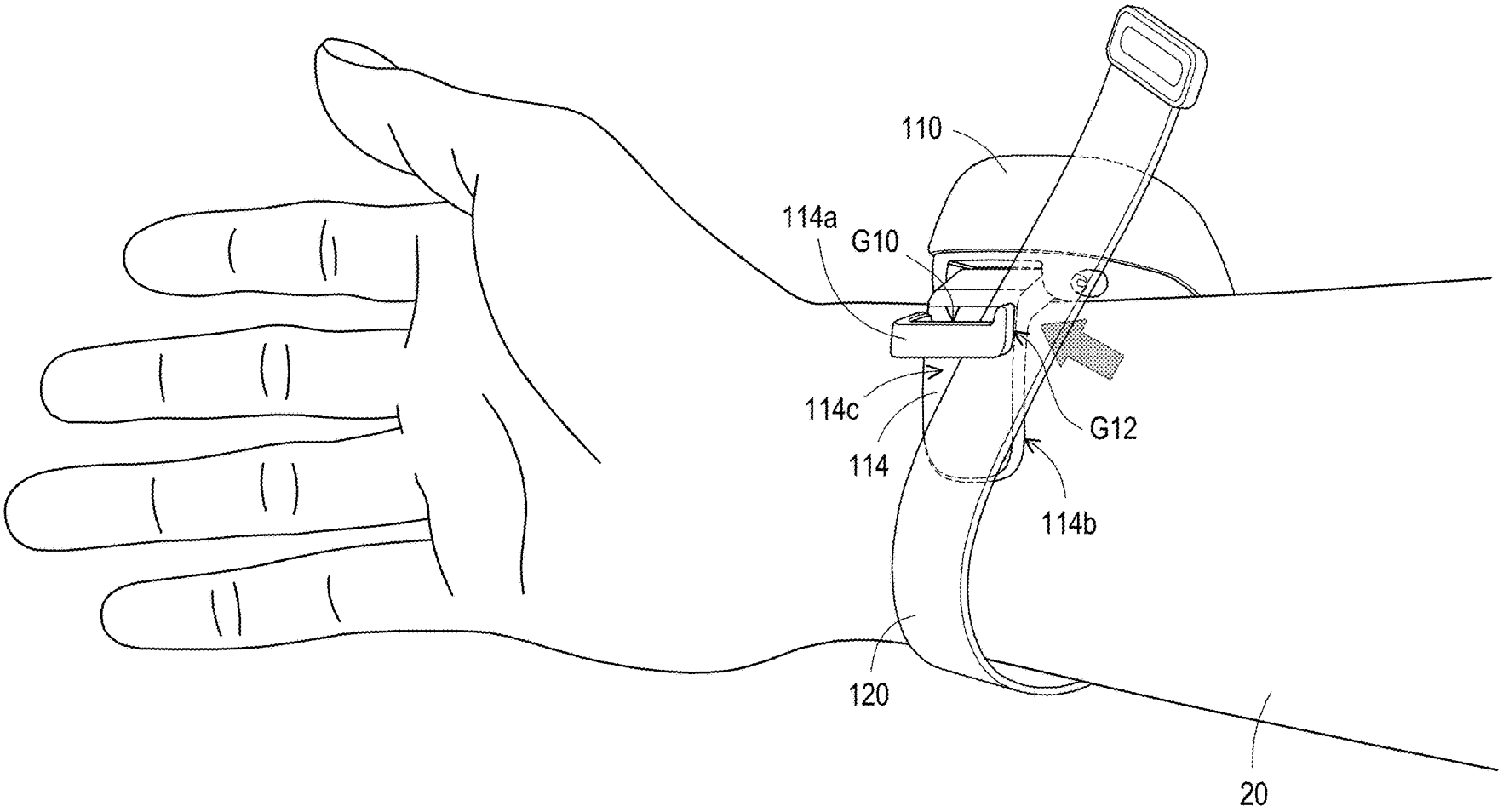
FIGS. 2 and 3 are schematic diagrams of the wearable device of FIG. 1 during the wearing process.
Figure 3:
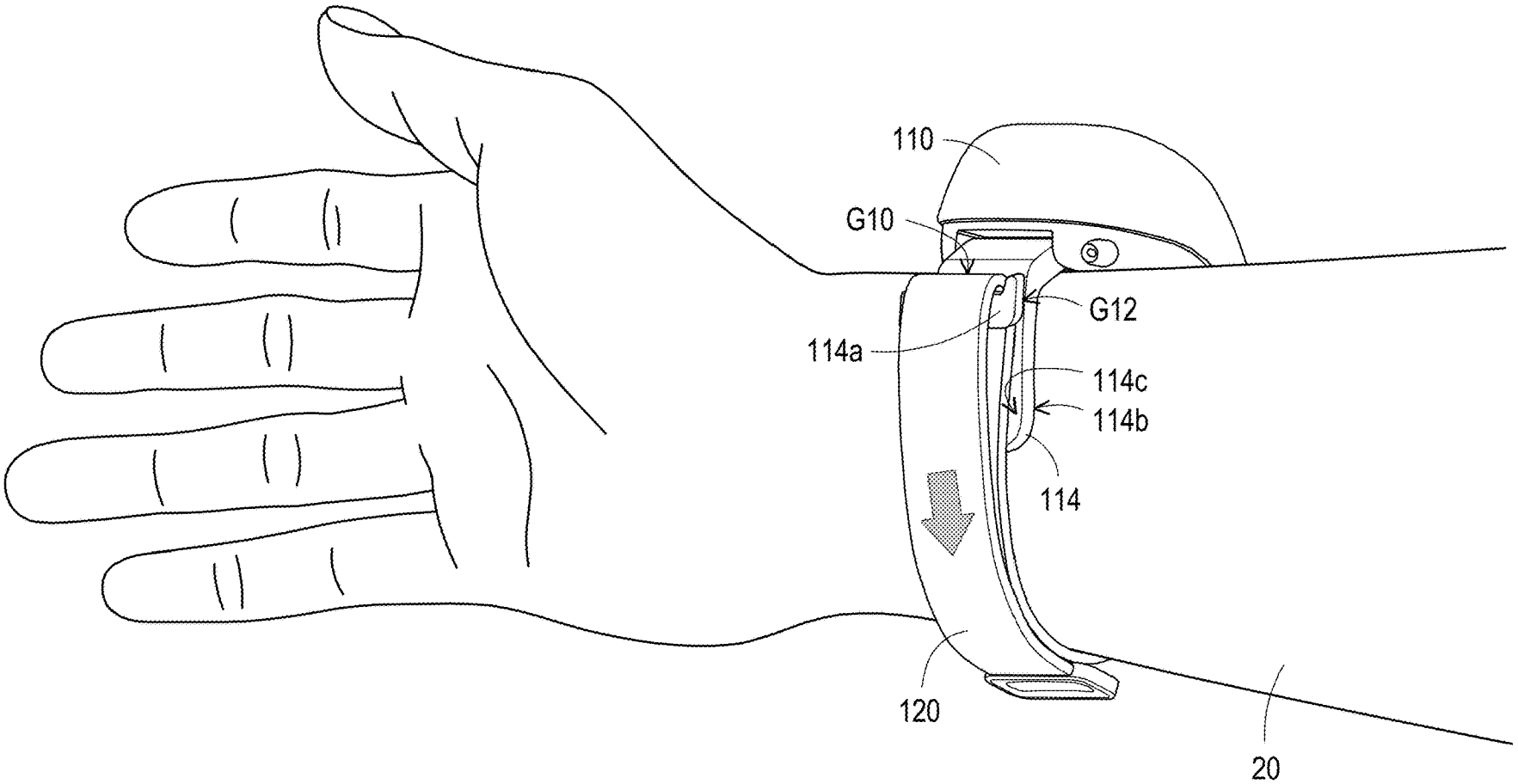

FIG. 1 is a schematic diagram of a wearable device according to an embodiment of the invention. FIGS. 2 and 3 are schematic diagrams of the wearable device of FIG. 1 during the wearing process. Referring to FIGS. 1 and 2, a wearable device 100 of the embodiment includes a main body 110 and a band body 120. The opposite sides of the main body 110 are provided with a tail portion 112*a* and a hook portion 114*a*, respectively. An open groove G10 is provided between the hook portion 114*a* and the other parts of the main body 110. One end of the band body 120 is connected to the tail portion 112*a*. The band body 120 enters the open groove G10 from an open side G12 of the open groove G10 and is folded back around the hook portion 114*a*. The other end of the band body 120 is fixed to a part of the band body 120, so that the band body 120 is coupled to the hook portion 114*a*. The band body 120 is adapted to fix the main body 110 to a subject 20. It should be noted that although the subject 20 in FIG. 2 is shown as a human wrist, the subject 20 may be a human body part such as a torso, an arm, a head, or other objects. The disclosure does not limit the types of the subject 20.

Referring to FIGS. 2 and 3, when wearing the wearable device 100 of the embodiment, the user may place the main body 110 on the subject 20 first. Next, pick up the other end of the band body 120 that is not connected to the tail portion 112*a* with one hand, so that the band body 120 enters the open groove G10 from the open side G12 of the open groove G10. During this process, the band body 120 does not need to be tightened relative to the subject 20, so there is no need to worry about pulling the main body 110 and causing the main body 110 to fall, and the subject 20 and the main body 110 do not need to be leaned against an object.

After the band body 120 enters the open groove G10, the user continues to hold the other end of the band body 120 to fold the band body 120 back around the hook portion 114*a*. Next, the user pulls the band body 120 in a direction away from the hook portion 114*a*, so that the band body 120 and the main body 110 are tightened to the subject 20 together. At this time, because the band body 120 has been folded back around the hook portion 114*a*, there is no need to worry about the main body 110 being dropped by being pulled, and the wearable device 100 can be temporarily and stably fixed to the subject 20 without any other support. When the degree of tightening is considered appropriate, the other end of the band body 120 held by the user may be fixed to a part opposite to the band body 120, so that the band body 120 is surely coupled to the hook portion 114*a*, and the main body 110 is fixed to the subject 20. The above actions may be easily performed with one hand, which is not only simple, but also takes less time to operate, so the wearable device 100 can be quickly put on and taken off. The actions may be performed quickly even with the non-dominant hand, which is also convenient to quickly change users.

Conversely, when removing the wearable device 100 from the subject 20, the fixation of the other end of the band body 120 and the part opposite to the band body 120 need only be disengaged, and the band body 120 is removed from the open groove G10. In the embodiment, the other end of the band body 124 is attached with a Velcro strip, magnetically attracted, or fastened to the part of the band body 124, but the disclosure is not limited thereto. Likewise, all of the above actions may be easily performed with one hand, which is not only simple, but also takes less time to operate.

In addition, in the wearable device 100 of the embodiment, the main body 110 is directly placed on the subject 20 to be fixed, and the band body 120 is placed in the open groove G10 and folded back around the hook portion 114*a*, so as to fix the main body 110 to the subject 20. In other words, it is not necessary to pass through the palm of the user in a state where both ends of the band body 120 are combined with the main body 110. That is, the length of the band body 120 does not need to consider the ergonomic dimension of the circumference of the user's palm, and the length of the band body 120 only needs to consider the ergonomic dimension of the circumference of the user's wrist. In this way, by calculating the length of the band body 120 by counting the ergonomic dimension data of the wrist circumference, the length of the band body 120 may be greatly shortened, the troubles of the user when handling the excess strap may be reduced, and the appearance after wearing may be more concise and beautiful.

In the embodiment, the main body 110 includes, for example, a device member 112, and the tail portion 112*a* is provided on the device member 112. The device member 112 is, for example, a watch body, a wireless positioning device, a virtual reality device, or a healthcare device. The disclosure does not limit the type of device member 112. In addition, as shown in FIG. 1, the appearance of the device member 112 of the embodiment is substantially L-shaped. When the user fixes the wearable device 100 to the subject 20 with corners or discontinuous arcs, the L-shaped device member 112 may support different planes of the subject 20 at the same time. Therefore, when the user fixes the wearable device 100 of the embodiment to the subject 20, even if the wearable device 100 is shaken a little, the L-shaped device member 112 may stably support the subject 20 without sliding easily. In other embodiments, the appearance of the device member 112 may also be in the shape of an arc or a plane. The disclosure does not limit the appearance shape of the device member 112.

Figure 4:
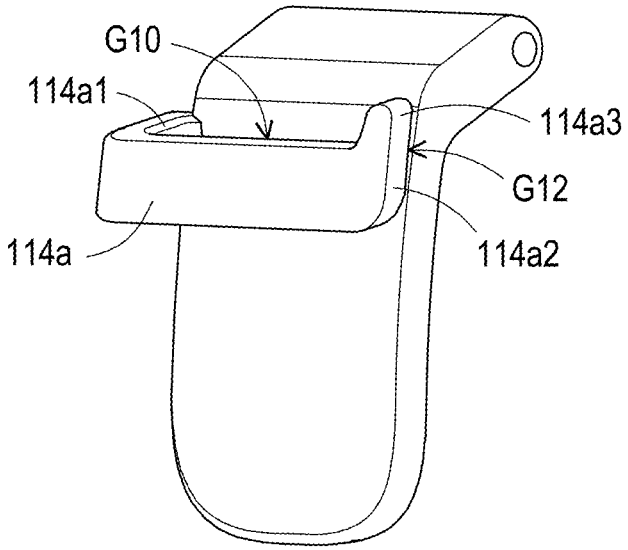
FIG. 4 is a schematic diagram of a clamping member of the wearable device of FIG. 1.

FIG. 4 is a schematic diagram of a clamping member of the wearable device of FIG. 1. Referring to FIGS. 1 and 4, the main body 110 of the embodiment further includes, for example, a clamping member 114 pivotally connected to the device member 112, and the hook portion 114*a* is provided on the clamping member 114. Since the clamping member 114 may pivot relative to the device member 112, the angle between the clamping member 114 and the device member 112 may be adjusted to be similar to the shape of the subject 20 (shown in FIG. 2), so as to provide solid strength during the fixation process of the wearable device 100. Therefore, there is no need to worry about pulling the main body 110 off when a coupling member 120 is pulled, and the main body 110 does not need to be leaned against other objects (e.g., a desktop or other parts of the body) to maintain stability. In addition, since the hook portion 114*a* is disposed on the clamping member 114, the position of the hook portion 114*a* also changes with the rotation of the clamping member 114, so that the wearable device 100 of the embodiment is adapted to be fixed to the subject 20 of different sizes.

In the embodiment, opposite ends of the hook portion 114*a* are a connecting end 114*a*1 and a free end 114*a*2, respectively, and the hook portion 114*a* is connected to other parts of the clamping member 114 by the connecting end 114*a*1. A stop portion 114*a*3 is provided on the free end 114*a*2. The stop portion 114*a*3 basically protrudes in the direction of the main body 110. Therefore, after the band body 120 enters the open groove G10 and is folded back around the hook portion 114*a*, the stop portion 114*a*3 may restrain the band body 120 in the open groove G10, thereby reducing the possibility that the band body 120 slips out of the open groove G10. However, the frictional force between the band body 120 and the hook portion 114*a* may be configured to prevent the band body 120 from slipping out of the open groove G10, and an appropriate structure may also be used to increase the frictional force between the band body 120 and the hook portion 114*a*. The disclosure is not limited to these designs.

The main body 110 of the embodiment further includes, for example, a torsion spring 116 (shown in FIG. 1), disposed at the pivotal connection between the clamping member 114 and the device member 112. When the device member 112 supports the subject 20, the torsion spring 116 provides elastic force to rotate the clamping member 114 toward the direction of the device member 112, so that the subject 20 is clamped between the clamping member 114 and the device member 112, and the wearable device 100 is not easy to slip off the subject 20. In the case of only one-handed operation, the user may put on or take off the wearable device 100 with peace of mind, and does not need to worry about the wearable device 100 slipping off and being damaged.

Referring to FIG. 2, the clamping member 114 of the embodiment is a curved shape. When the main body 110 is fixed to the subject 20, a concave side 114*b* of the clamping member 114 faces the subject 20. In the embodiment, the hook portion 114*a* is provided on a convex side 114*c* of the clamping member 114. Since the clamping member 114 is a curved shape, when the wearable device 100 is fixed to the subject 20, the clamping member 114 may better fit the subject 20 and be firmly fixed to the subject 20. Meanwhile, the hook portion 114*a* and the subject 20 are located on opposite sides of the clamping member 114, so the band body 120 may smoothly enter the open groove G10 without pinching, pressing or interfering with the subject 20. When disengaging the fixation, the angle of the band body 120 and the hook portion 114*a* is parallel, and the hook portion 114*a* does not jam the band body 120, so the band body 120 may be easily separated from the hook portion 114*a* to achieve the design purpose of quick putting on and taking off.

When the user wears a conventional wearable device, the conventional wearable device can be stably fixed only by completing actions such as passing the band body through the fixing ring, adjusting the length of the band body and fixing the band body at one time. Compared with the prior art, when the user fixes the wearable device 100 of the embodiment to the subject 20, the band body 120 may be inserted into the open groove G10 and folded back around the hook portion 114*a* to complete the preliminary fixation, and the length of the band body 124 is adjusted to further stabilize the wearable device 100 on the subject 20. When fixing the wearable device 100 of the embodiment, the user may operate in stages without completing the actions at one time, which improves the convenience of the user's operation. In addition, the user may easily adjust the length of the band body 120 to fix the wearable device 100 to the subject 20 of different sizes. During the wearing process, there is no need to perform the action of passing the band body 120 through the buckle or other unnecessary actions, so as to avoid interference or misoperation. Moreover, the wearable device 100 is not pushed to deviate from the predetermined ideal position, so as to achieve the purpose of quick putting on and taking off.

Figure 5:
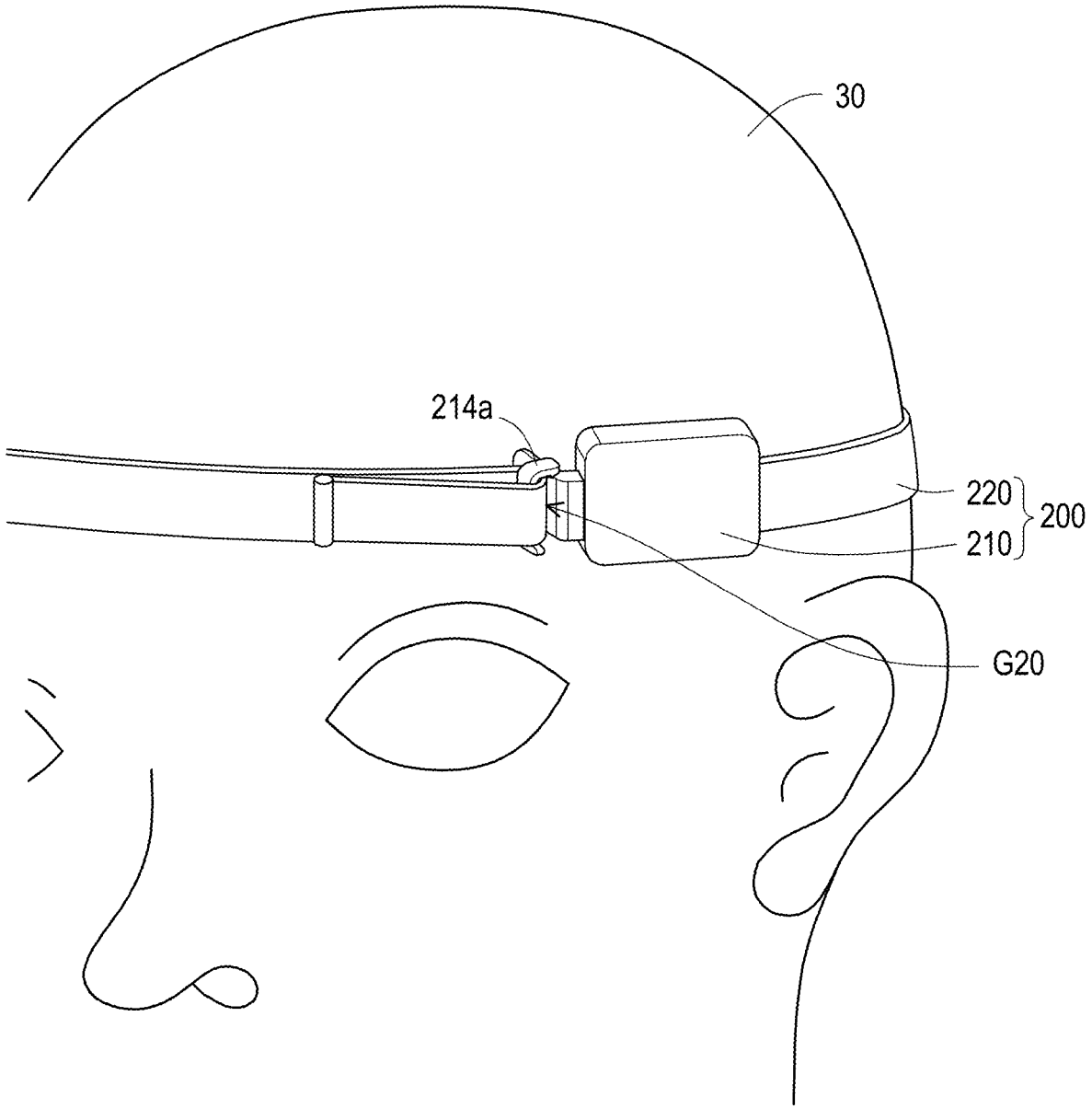
FIGS. 5 and 6 are schematic diagrams of different parts of a user wearing a wearable device according to other embodiments of the invention, respectively.
Figure 6:
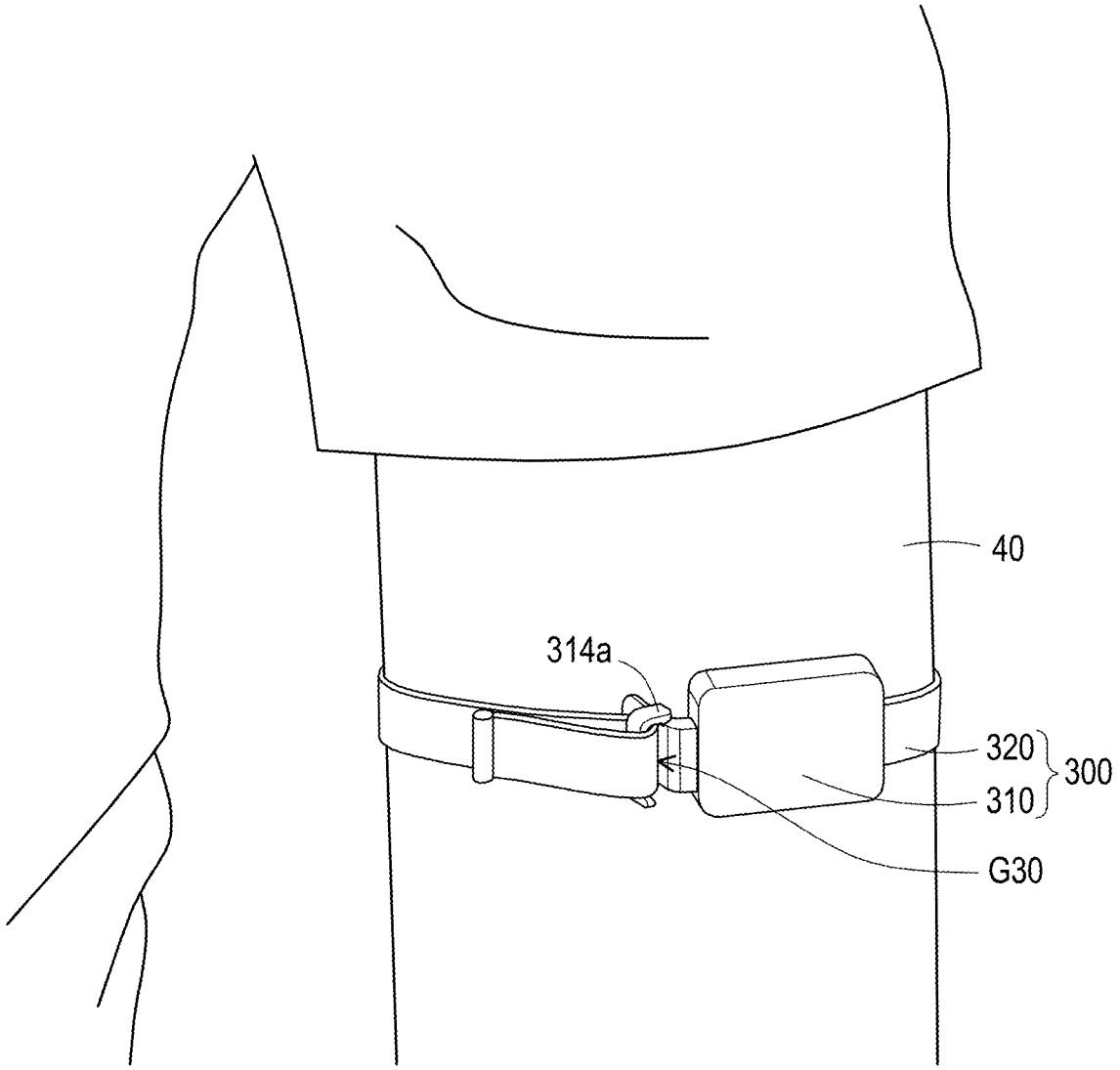

FIGS. 5 and 6 are schematic diagrams of different parts of a user wearing a wearable device according to other embodiments of the invention, respectively. Referring to FIG. 5, a wearable device 200 of the embodiment is similar to the wearable device 100 of FIG. 2, and the difference is that the wearable device 200 of the embodiment is worn on a subject 30, and the subject 30 is the user's head. The wearable device 200 also includes a main body 210 and a band body 220, and the band body 220 may be inserted into an open groove G20 and folded back around a hook portion 214*a* and fixed to a part opposite to the band body 220, so that the band body 220 is coupled to the hook portion 214*a*, and the main body 210 is fixed to the subject 30.

Referring to FIG. 6, a wearable device 300 of the embodiment is similar to the wearable device 100 of FIG. 2, and the difference is that the wearable device 300 of the embodiment is worn on a subject 40, and the subject 40 is the user's arm. The wearable device 300 also includes a main body 310 and a band body 320, and the band body 320 may be inserted into an open groove G30 and folded back around a hook portion 314*a* and fixed to a part opposite to the band body 320, so that the band body 320 is coupled to the hook portion 314*a*, and the main body 310 is fixed to the subject 40.

In summary, in the wearable device of the disclosure, the user only needs to fold back the band body around the hook portion or separate the band body from the hook portion, and the wearable device may be put on and taken off. The method of operating the wearable device is simple, the time required for putting on and taking off the wearable device is reduced, and the trouble of the user in dealing with the excess strap is also reduced. Therefore, the wearable device of the disclosure may be quickly put on or taken off. In addition, the length of the band body may be easily adjusted to fix the wearable device to the subject of different sizes. When the clamping member and the torsion spring are selectively disposed, the main body may be fixed to the subject without easily slipping off and being damaged, thereby specifically leaning on other objects to keep the main body stable is not necessary. With the above design, the wearable device of the disclosure helps to improve the user's overall operating experience.

What is claimed is:

1. A wearable device, comprising:

a main body, opposite sides of the main body provided with a tail portion and a hook portion, respectively, wherein an open groove is provided between the hook portion and other parts of the main body; and a band body, one end of the band body connected to the tail portion, the band body entering the open groove from an open side of the open groove and folded back around the hook portion, and the other end of the band body fixed to a part of the band body, so that the band body is coupled to the hook portion, wherein the band body is adapted to fix the main body to a subject, wherein the main body comprises a device member and a clamping member, the clamping member is pivotally connected to the device member, the tail portion is provided on the device member, and the hook portion is provided on the clamping member, wherein the main body further comprises a torsion spring, disposed at the pivotal connection between the clamping member and the device member.

2. The wearable device according to claim 1, wherein the clamping member is a curved shape, and when the main body is fixed to the subject, a concave side of the clamping member faces the subject.

3. The wearable device according to claim 2, wherein the hook portion is provided on a convex side of the clamping member.

4. The wearable device according to claim 1, wherein opposite ends of the hook portion are a connecting end and a free end, respectively, the hook portion is connected to other parts of the clamping member by the connecting end, a stop portion is provided on the free end, and the stop portion confines the band body to the open groove.

5. The wearable device according to claim 1, wherein the other end of the band body is attached with a Velcro strip, magnetically attracted, or fastened to the part of the band body.

* * * * *